US007363734B2

(12) United States Patent
Arzberger et al.

(10) Patent No.: US 7,363,734 B2
(45) Date of Patent: Apr. 29, 2008

(54) LUBRICATED TRENCH WALL CUTTER WITH REMOTE LUBRICANT INLET PORT

(75) Inventors: Maximilian Arzberger, Igenhausen (DE); Ignaz Seitle, Karlshuld (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 76 days.

(21) Appl. No.: 11/289,870

(22) Filed: Nov. 30, 2005

(65) Prior Publication Data

US 2006/0120641 A1 Jun. 8, 2006

(30) Foreign Application Priority Data

Dec. 3, 2004 (EP) ..... 04028687

(51) Int. Cl.
*E02F 3/14* (2006.01)
*E02F 5/08* (2006.01)

(52) U.S. Cl. ..... 37/465.91; 384/93; 175/229

(58) Field of Classification Search ..... 37/465, 37/352, 91, 364, 337; 384/93
See application file for complete search history.

(56) References Cited

U.S. PATENT DOCUMENTS 5,027,911 A * 7/1991 Dysart ..... 175/57
5,964,305 A * 10/1999 Arzberger et al. ..... 175/91

FOREIGN PATENT DOCUMENTS

DE 196 52 022 A1 6/1998
EP 0 518 293 A1 6/1992
EP 04 02 8687 3/2005

* cited by examiner

*Primary Examiner*—Thomas B. Will
*Assistant Examiner*—Mai T Nguyen
(74) *Attorney, Agent, or Firm*—Hoffman, Warnick & D'Alessandro LLC

(57) ABSTRACT

The invention relates to a trench wall cutter comprising a bearing shield, on which at least one cutting wheel is supported in a rotatable manner. Between the cutting wheel and the bearing shield at least one sealing member is provided. For the lubrication of the sealing member a lubricating device is provided, which has a lubricant inlet port arranged above the cutting wheel.

9 Claims, 4 Drawing Sheets

LUBRICATED TRENCH WALL CUTTER WITH REMOTE LUBRICANT INLET PORT

The invention relates to a trench wall cutter comprising a cutting frame, at least one bearing shield arranged on the cutting frame, at least one axis arranged on the bearing shield, at least one cutting wheel having a cutting wheel hub, which is supported on the axis in a rotatable manner by means of at least one bearing, a driving device to drive the at least one cutting wheel in a rotating manner, a drive train arranged at the top of the bearing shield and at least one sealing member arranged between the bearing shield and the cutting wheel to seal the bearing against the area surrounding the trench wall cutter.

A trench wall cutter is known for example from DE 196 52 022 C2. In this known trench wall cutter a cutting wheel drive to drive the cutting wheels in a rotating manner is arranged above the bearing shield on the cutting frame. In order to transmit the torque from the cutting wheel drive to the cutting wheels a drive shaft is provided, which extends in a drive train designed in a tubular manner in the bearing shield.

The object of the invention is to provide a trench wall cutter that is particularly reliable and can be operated in a particularly economical way.

The object is solved according to the invention by a trench wall cutter having the features of claim 1. Preferred embodiments are stated in the dependent claims.

The trench wall cutter according to the invention is characterized in that at least one lubricating device is provided for feeding lubricant to the sealing member, and in that the lubricating device has a lubricant inlet port arranged above the cutting wheel.

A fundamental idea of the invention can be seen in the fact that a lubricating device is provided for lubricating the sealing member, the lubricating device having an inlet port for lubricants that is arranged in a portion spaced from the cutting wheel hub. Such an arrangement of the lubricant inlet port is of particular advantage when the sealing member is covered with respect to its surrounding area by the cutting wheel and/or the bearing shield. If, in such case, a lubricating device, such as a lubricating nipple having a lubricant inlet port is provided directly on the sealing member, the cutting wheel needs to be dismantled at least partly from the cutting wheel hub in order to supply fresh lubricant, which leads to undesirable idle times and involves a comparably high expenditure of work. In contrast to this, in the arrangement of the lubricant inlet port according to the invention lubricant can be supplied to the lubricating device without dismantling the cutting wheel and/or the bearing shield, whereby an operation of the trench wall cutter is rendered possible that involves only a minimum of work and is therefore particularly economical. In addition, the arrangement of the lubricant inlet port according to the invention permits a continuous feeding of lubricant to the lubricating device, as a result of which a particularly reliable lubrication of the sealing member and consequently a particularly reliable cutting operation is rendered possible. In accordance with the invention the lubricant can be supplied whilst the gear unit and/or cutting wheel is rotating, in particular during the cutting operation, which allows for a particularly good distribution of the lubricant on the sealing member even in the case of low injection pressures. As a result, local overloads occurring on the sealing member can be prevented to a large extent. The lubricant concerned can be an oil and/or a grease.

According to the invention the drive train can be understood in particular as a device arranged between the cutting frame and the bearing shield, which serves to supply driving power from the cutting frame to the cutting wheel. For this purpose for example a drive shaft can be provided in the drive train, which connects a drive motor located on the cutting frame with the cutting wheel. Alternatively or additionally, in the drive train hydraulic pressure lines can be provided for the supply of a drive motor for the cutting wheel which is arranged on the bearing shield. The drive train can be designed in the bearing shield as a recess, e.g. as a borehole.

In accordance with the invention a trench wall cutter having a particularly simple construction is provided in that the lubricating device has at least one lubricant feeding channel, at whose end the lubricant inlet port is arranged, and by preference the lubricant feeding channel extends at least in portions along the drive train. In the case of a trench wall cutter that can be produced in a particularly simple way the lubricant feeding channel has a borehole applied in the bearing shield. Advantageously, the borehole extends from the circumference of the bearing shield in the direction of the axis. At the lubricant inlet port a connecting device for a lubricant supply device, such as a pump, may be provided. More particularly, the connecting device can be designed as a hose connection for connecting a lubricant hose.

The lubricant feeding channel can be arranged in particular paraxially to the drive train, which can be designed for example with a cross section that is at least in some portions circular, square or hexagonal. However, for a particularly easy access to the lubricant inlet port it may be preferred that the lubricant feeding channel includes an acute angle with the drive train. By preference, this angle ranges between 10 and 45°, preferably between 18 and 28°, in particular 22.5°. In order to further improve the accessibility to the lubricant inlet port, provision is made for the said port to be arranged preferably below a front face of the frame.

Another preferred embodiment of the invention resides in that the lubricant inlet port is arranged at the circumference of the bearing shield. As a result of such an arrangement of the lubricant inlet port the feeding of lubricant into the lubricant feeding channel and therefore to the sealing member is facilitated further. According to the invention the circumference of the bearing shield can be understood as an external side of the bearing shield that envelops the bearing shield, in particular around an axis of rotation of the at least one cutting wheel. The bearing shield can also be referred to as cutting shield.

A particularly reliable trench wall cutter is provided in that the lubricating device has at least one lubricant outlet channel, which preferably extends at least approximately parallel to the axis and at whose end an outlet port for the lubricant is provided in particular above the sealing member. It is suitable for the lubricant outlet channel to have a line connection with the lubricant feeding channel and/or the lubricant inlet port. Advantageously, the outlet port is arranged in an upper portion of the bearing shield above the axis. In an arrangement of such kind the lubricant is able to spread in a particularly effective way on the sealing member during the operation of the cutting wheel so that a particularly good lubrication is ensured. Basically, the outlet port for the lubricant can be provided outside a sealing space, i.e. outside of such a space that is separated by the sealing member against the area surrounding the trench wall cutter. It is in this sealing space that the at least one bearing is arranged. However, the outlet port can also be located inside the sealing space. In the case of the outlet port being disposed outside the sealing space, it is suitably provided in an upper portion of the sealing member. However, if the outlet port is provided in the inside of the sealing space, it is suitably arranged in a lower portion of the sealing member. Advantageously, the lubricant outlet channel has a borehole which, for the purpose of particularly short line distances, suitably extends at least approximately parallel to the axis of the bearing shield.

It is particularly advantageous for a step-shaped lubricant intermediate channel to be arranged between the lubricant feeding channel and the lubricant outlet channel. The lubricant intermediate channel can include several boreholes that are in particular shut in some portions and merge into each other. Owing to its step-shaped construction the lubricant intermediate channel can be provided by being spaced from the driving devices and/or the gear unit of the bearing shield. It is advantageous for the lubricant intermediate channel to extend at least in some portions parallel to the lubricant feeding channel and/or the lubricant outlet channel.

To supply driving power to the cutting wheel for example electric lines, hydraulic lines and/or other pressure medium lines can be provided on the drive train. In such case the drive motor can be provided on the bearing shield, especially inside it. However, it is particularly preferred that in the drive train a drive shaft is provided to drive the at least one cutting wheel in a rotating manner. In this case the drive motor for the cutting wheels can be spaced from the bearing shield by being provided in particular on the cutting frame, with the drive shaft serving to transmit the torque from the drive motor to the cutting wheel. According to this embodiment the bearing shield can be designed in a particularly compact manner.

In order to achieve a particularly effective lubrication the outlet port is preferably designed in an elongated manner along the sealing member, more particularly having a ring-segmented or an annular design. Provision can also be made for several outlet ports on the sealing member.

A particularly cost-effective and reliable trench wall cutter can be achieved in that the sealing member is arranged between the bearing shield and the cutting wheel hub. In accordance with this embodiment the sealing member can be kept particularly small and therefore cost-effective. In addition, the sealing space and the sealing surface are also very small so that the reliability of the trench wall cutter according to the invention is increased further. In principle, the sealing member may also be provided in the portion of the cutting wheel circumference.

It is especially advantageous for the sealing member to have at least one sealing ring, which is preferably arranged coaxially to the axis. The sealing member can be designed for instance as a lamellar seal or a labyrinth seal.

The reliability of the trench wall cutter according to the invention can be enhanced further in that the sealing member has at least two sealing rings, in particular disposed opposite each other at the front face, one of which is arranged on the cutting wheel and the other is arranged on the bearing shield. Hence, according to this embodiment two corresponding sealing rings are provided, which rest against each other during the operation of the trench wall cutter. In principle, however, the sealing rings can also be provided by being offset with respect to each other. Provision can also be made for further sealing rings.

A particularly fast cutting progress can be attained in that on both sides of the bearing shield a cutting wheel is each provided in particular in a coaxial manner, with each cutting wheel having its own lubricating device. The trench wall cutter suitably has two or four of these bearing shields with two cutting wheels each. Advantageously, two bearing shields are provided on the ground-facing side of the cutting frame and optionally two further cutting wheels are arranged at the top of the cutting frame. In principle, however, any chosen number of cutting wheels may be provided. Besides completely separate lubricating devices employed for the cutting wheels the lubricating devices can also have common elements, such as a common lubricant feeding channel and/or a common lubricant inlet port.

In the following the invention will be described in greater detail by way of preferred embodiments schematically illustrated in the Figures, wherein.

Figure 1:
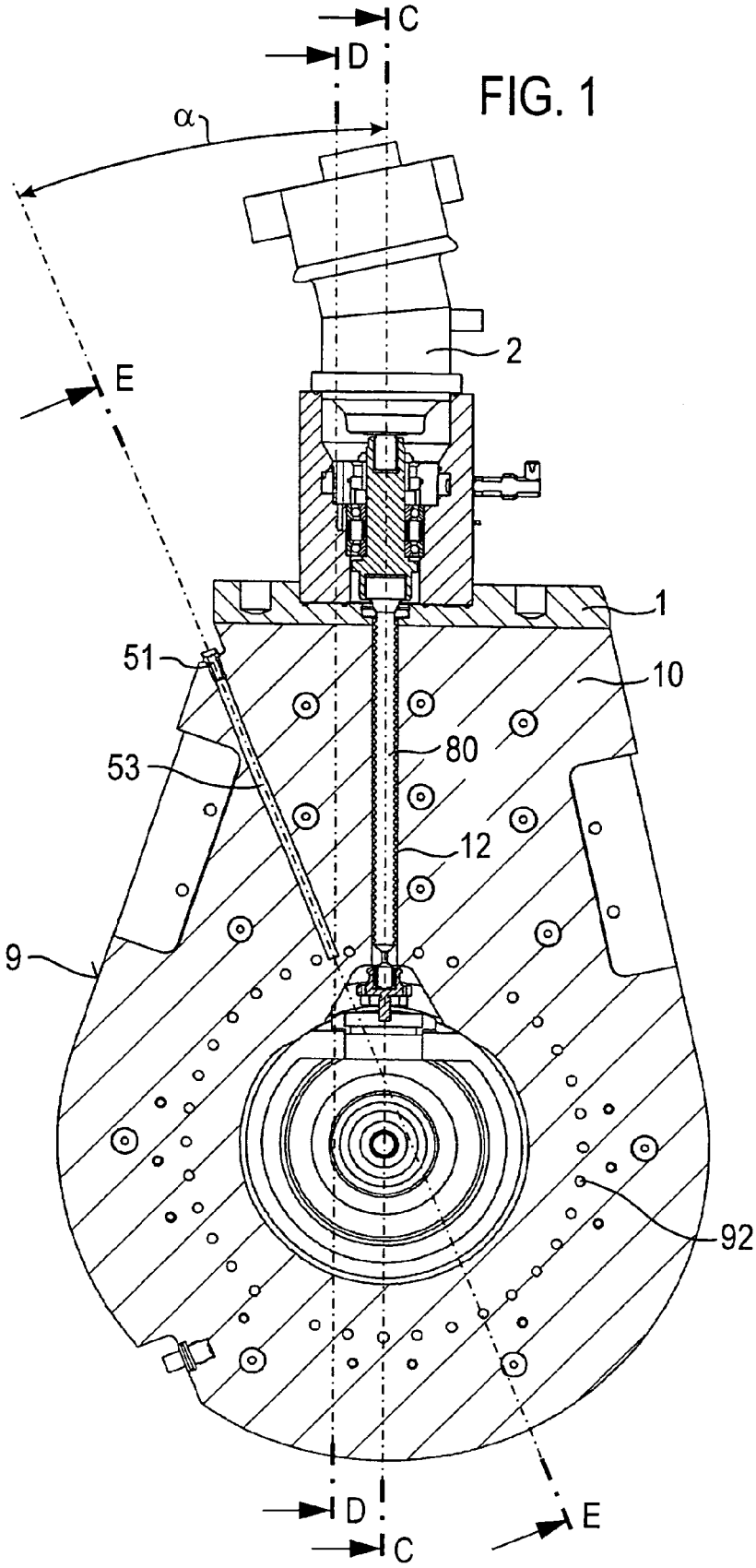
FIG. 1 shows a longitudinal section of a trench wall cutter according to the invention.
Figure 2:
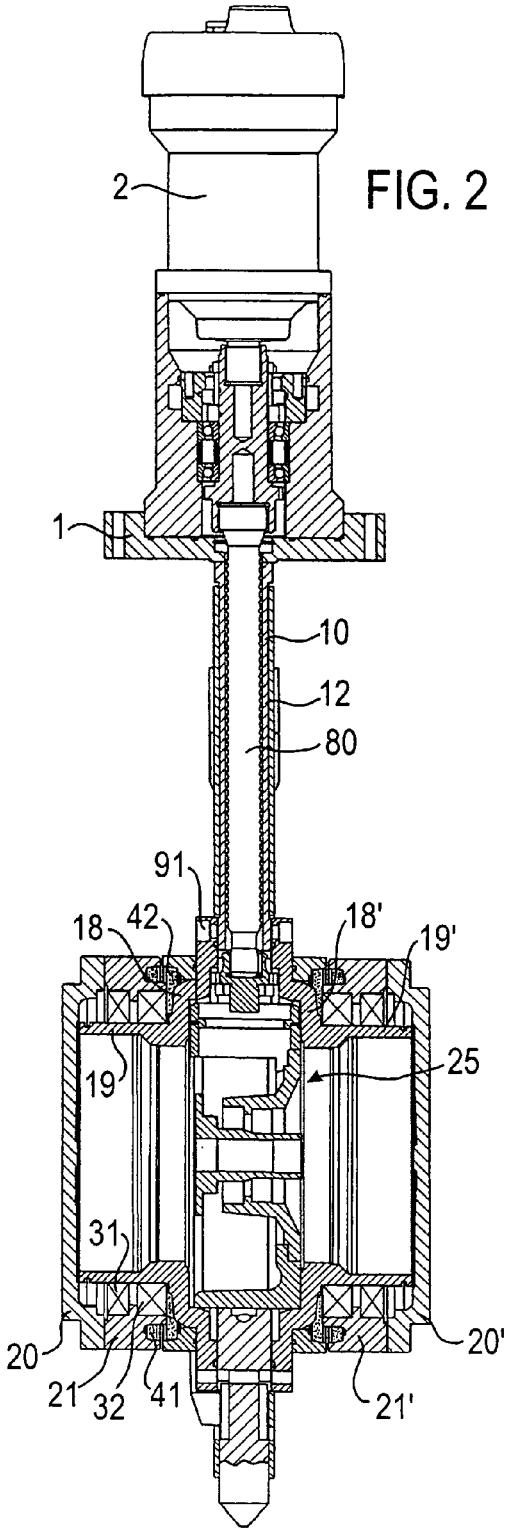
FIG. 2 shows a longitudinal section C-C of the trench wall cutter from FIG. 1.
Figure 3:
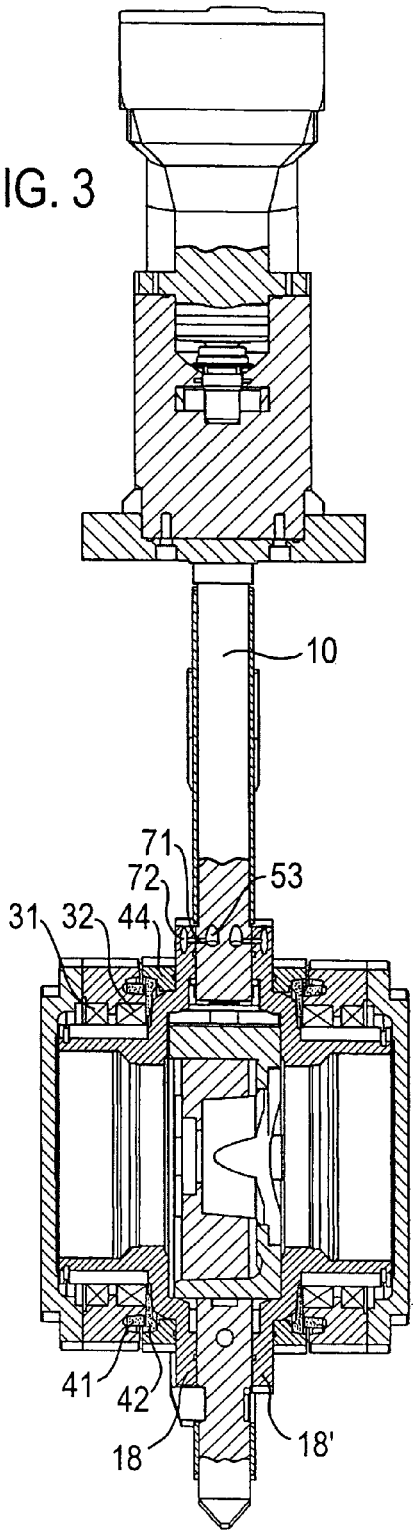
FIG. 3 shows a longitudinal section D-D of the trench wall cutter from FIG. 1.
Figure 4:
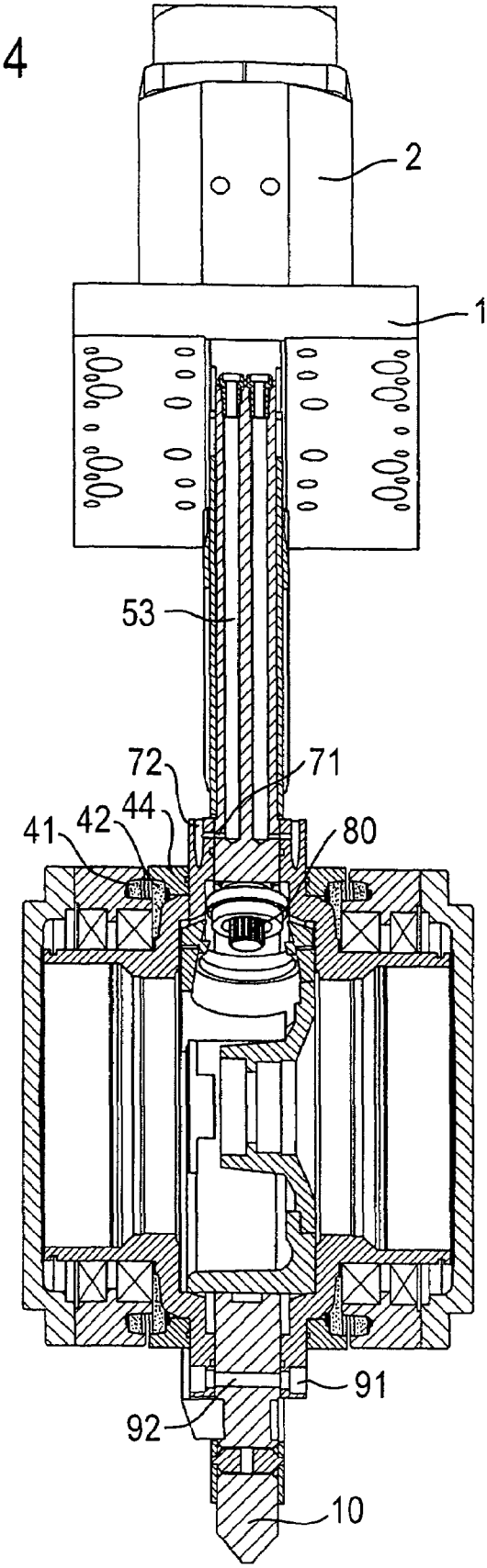
FIG. 4 shows a longitudinal section E-E of the trench wall cutter from FIG. 1.

Elements having the same function are designated with the same reference signs in all Figures.

In FIGS. 1 to 4 schematic views of a trench wall cutter according to the invention are shown. The trench wall cutter has a bearing shield 10, on both sides of which an axis 19, 19' projects respectively. On these axes 19, 19' that are arranged coaxially a cutting wheel 20, 20' is each supported in a rotatable manner, which is depicted in part only and has a respective cutting wheel hub 21, 21'.

The axes 19 and 19' are each designed on axis members 18, 18' which are screw-mounted on the bearing shield 10 on both sides thereof. The shell-like axis members 18, 18' have circular and sleeve-like portions that are connected to each other in a stepped manner. To fix the axis members 18, 18' on the bearing shield 10 boreholes 91 are provided in the axis members 18, 18' that correspond to boreholes 92 located in the bearing shield 10.

At its upper end the bearing shield 10 has a tubular-shaped drive train 12. The drive train 12 serves to supply power for driving the cutting wheels 20, 20' in a rotating manner. At its upper end the bearing shield 10 is fixed to a cutting frame 1, depicted only in part here, of the trench wall cutter. In the inside of the drive train 12 a drive shaft 80 extends which is operated by a drive motor 2 arranged on the cutting frame 1 and which transmits a torque from the said motor via a gear unit 25 located in the bearing shield 10 to the cutting wheels 20, 20'. Alternatively, the drive motor can also be arranged on the bearing shield 10, in which case hydraulic lines for the power supply of the drive motor can extend through the drive train 12.

In the following the construction of the cutting wheels 20, 20', their bearing as well as the accompanying bearing seal and bearing lubrication will be described in an exemplary manner for cutting wheel 20. The corresponding devices for cutting wheel 20' are designed by analogy.

To support the cutting wheel hub 21 of cutting wheel 20 on the axis 19 of the bearing shield 10 two bearings 31 and 32 arranged next to each other are provided that can be designed as roller bearings for example. In order to seal the bearings 31, 32 against the area surrounding the trench wall cutter, especially against support suspension present in the trenches to be made, two sealing members 41 and 42 designed as sealing rings are provided. The sealing member 41 is embedded in the cutting wheel hub 21, while the sealing member 42 is arranged on the bearing shield 10. The two sealing members 41, 42 are arranged directly adjacent to each other in the axial direction and rest against each other for sealing purposes.

For the lubrication of the two sealing members 41, 42 a lubricating device is provided. As can be seen especially in the embodiment of FIG. 5, this lubricating device has an outlet port 61 for lubricant, which is provided above the two sealing members 41, 42, i.e. on the bearing shield 10 when seen from the cutting frame 1. The outlet port 61 is provided outside a sealing space formed by the sealing members 41, 42 in the inside of the cutting wheel hub 21.

The outlet port 61 is followed by a lubricant outlet channel 63, which extends approximately paraxially to the axis 19 into an annular retaining member 44 that serves to retain the sealing member 42. From there the lubricant outlet channel extends into the axis member 18 while still being approximately paraxial to the axis 19.

In the axis member 18 the lubricant outlet channel 63 merges into a channel 72 extending approximately perpendicularly to the axis 19. This vertically extending channel 72 is formed in the axis member 18 by a borehole closed to the outside with a plug 75.

The channel 72 merges for its part into a channel 71 that extends approximately paraxially to the axis 19. The horizontally extending channel 71 is provided both in the axis member 18 and in the cutting shield 10. Together the channels 71, 72 can also be referred to as lubricant intermediate channel 70. Inside the axis member 18 and above the gear unit 25 the two channels 71, 72 form a step-shaped arrangement.

The channel 71 merges for its part into a lubricant feeding channel 53 that extends upwards inside the bearing shield 10. The lubricant feeding channel 53 extends upwards along the drive train 12 whilst including with said drive train 12 an angle $\alpha$ of 22.5° with the said drive train 12. At the upper end of the drive train 12 the lubricant feeding channel 53 ends in a lubricant inlet port 51, on which a hose connection may be provided for example. The lubricant inlet port 51 is arranged on the outside of the trench wall cutter, below the cutting frame 1 on the circumference 9 of the cutting shield 10, i.e. at the enveloping external surface of the latter.

The channels 53, 71, 72, 63 serve to feed lubricant to the two sealing members 41, 42. The lubricant can be introduced in the portion of the cutting frame 1 into the lubricant inlet port 51 and is conveyed through the channels 53, 71, 72, 61 to the sealing members 41, 42. The lubricant inlet port 51 is provided at the top of the cutting shield 10 in a portion spaced from the cutting wheels 20, 20' so that there is no need for the cutting wheels 20, 20' to be dismantled in order to supply lubricant.

Figure 5:
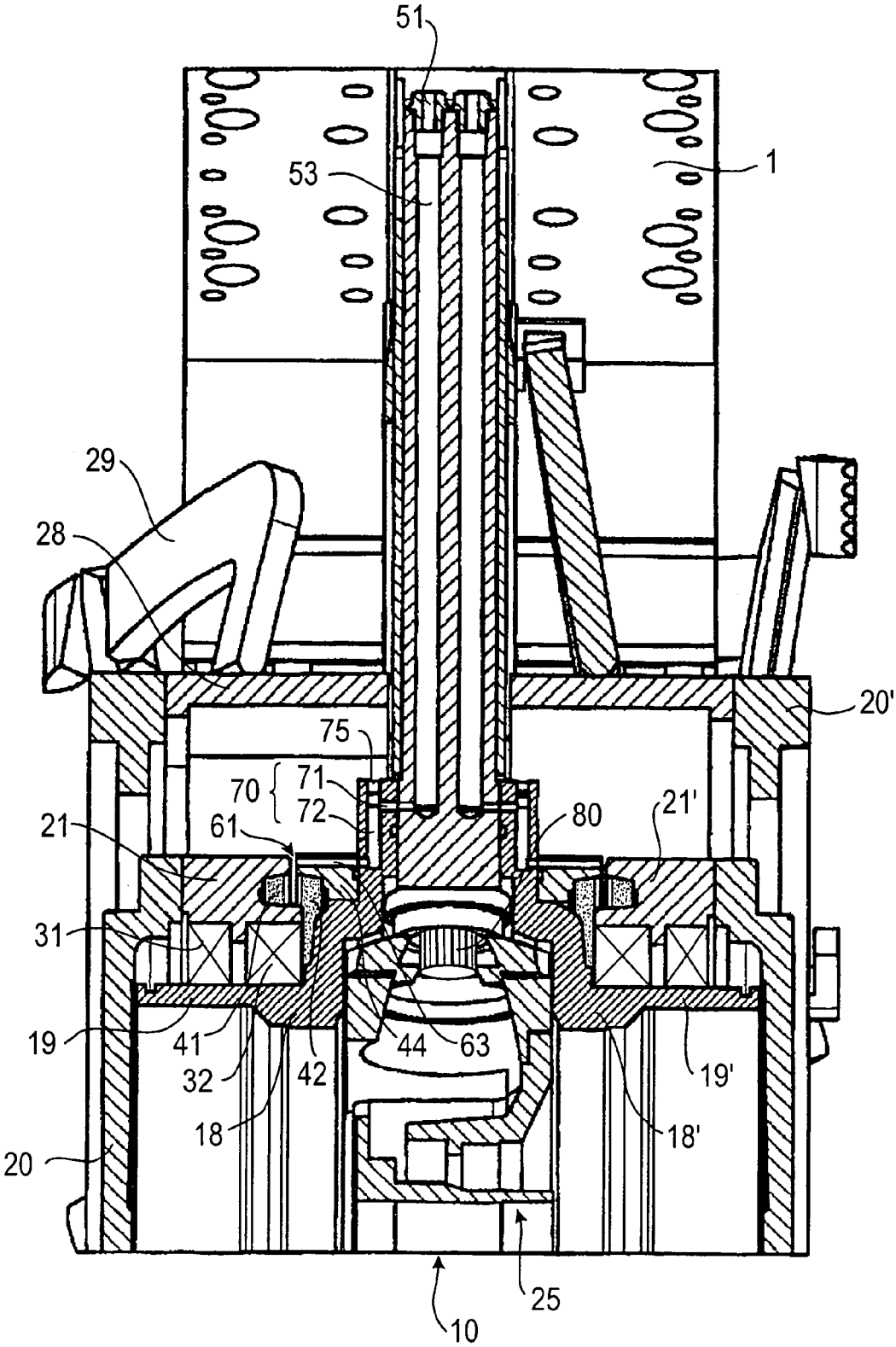
FIG. 5 shows a longitudinal section E-E of a further trench wall cutter depicted in detail.

The cutting wheel 20 of FIG. 5 has a surface portion 28 in the shape of a cylinder barrel, at the circumference of which cutting and mixing teeth 29 are arranged for stripping and mixing outcropping soil material. The surface portion 28 extends coaxially to the cutting wheel hub 21 whilst covering the sealing members 41, 42 in the radial direction against the area surrounding the trench wall cutter. The cutting wheel 20' is designed by analogy.

The invention claimed is:

1. Trench wall cutter comprising a cutting frame, at least one bearing shield arranged on the cutting frame, at least one axis arranged on the bearing shield, at least one cutting wheel having a cutting wheel hub, which is supported on the axis in a rotatable manner by means of at least one bearing, a driving device to drive the at least one cutting wheel in a rotating manner, which driving device has a drive motor located on the cutting frame, a recess in the bearing shield forming a drive train arranged at the top of the bearing shield, a drive shaft located in the drive train, which connects the drive motor located on the cutting frame with the cutting wheel for transmitting a torque from the drive motor to the at least one cutting wheel, at least one sealing member arranged between the bearing shield and the cutting wheel to seal the bearing against the area surrounding the trench wall cutter, and at least one lubricating device for feeding lubricant to the sealing member, wherein the lubricating device has a lubricant inlet port arranged above the cutting wheel when operated by a user, wherein the lubricating device has at least one lubricant feeding channel, at whose end the lubricant inlet port is arranged, the lubricant feeding channel extending at least in portions along the drive train and the drive shaft located therein, wherein the lubricant feeding channel includes an acute angle (.alpha.) with the drive train and the shaft located therein, and wherein the lubricant inlet port is arranged at the circumference of the bearing shield, the circumference enveloping the bearing shield around an axis of rotation of the at least one cutting wheel.

2. Trench wall cutter according to claim 1, wherein the lubricating device has at least one lubricant outlet channel.

3. Trench wall cutter according to claim 2, wherein between the lubricant feeding channel and the lubricant outlet channel a step-like lubricant intermediate channel is arranged.

4. Trench wall cutter according to claim 1, wherein the sealing member is arranged between the bearing shield and the cutting wheel hub.

5. Trench wall cutter according to claim 1 wherein the sealing member has at least one sealing ring, which is arranged coaxially to the axis.

6. Trench wall cutter according to claim 1, wherein the sealing member has at least two sealing rings, disposed opposite each other at a front face of the cutting frame, one of which is arranged on the cutting wheel and the other is arranged on the bearing shield.

7. Trench wall cutter according to claim 1, wherein on both sides of the bearing shield a cutting wheel is each provided in a coaxial manner, with each cutting wheel having its own lubricating device.

8. Trench wall cutter according to claim 1, wherein the lubricant inlet port is arranged below a front face of the cutting frame.

9. Trench wall cutter according to claim 2, wherein the at least one lubricant outlet channel extends at least approximately parallel to the axis and at whose end an outlet port for the lubricant is provided above the sealing member.

* * * * *